US009771767B2

(12) United States Patent
Sanchez et al.

(10) Patent No.: US 9,771,767 B2
(45) Date of Patent: Sep. 26, 2017

(54) SHORT HOP COMMUNICATIONS FOR A SETTING TOOL

(71) Applicant: BAKER HUGHES INCORPORATED, Houston, TX (US)

(72) Inventors: James S. Sanchez, Tomball, TX (US); Edward J. O'Malley, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 236 days.

(21) Appl. No.: 14/528,641

(22) Filed: Oct. 30, 2014

(65) Prior Publication Data

US 2016/0123129 A1 May 5, 2016

(51) Int. Cl.

| | |
|---|---|
| ***E21B 43/26*** | (2006.01) |
| ***E21B 43/116*** | (2006.01) |
| ***E21B 23/00*** | (2006.01) |
| ***E21B 23/04*** | (2006.01) |
| ***E21B 41/00*** | (2006.01) |
| ***E21B 47/12*** | (2012.01) |
| *E21B 34/00* | (2006.01) |

(52) U.S. Cl.
CPC ..... *E21B 23/00* (2013.01); *E21B 23/04* (2013.01); *E21B 41/00* (2013.01); *E21B 47/12* (2013.01); *E21B 2034/005* (2013.01)

(58) Field of Classification Search
CPC ..... E21B 43/11; E21B 43/116; E21B 43/117; E21B 43/1185; E21B 43/26; E21B 44/005
USPC ..... 166/299, 63, 250.11, 65.1, 66
See application file for complete search history.

(56) References Cited

U.S. PATENT DOCUMENTS

| | | | | |
|---|---|---|---|---|
| 4,656,944 A * | 4/1987 | Gonzalez | E21B 1/00 | 102/202 |
| 6,536,524 B1 * | 3/2003 | Snider | E21B 23/00 | 166/297 |
| 7,913,603 B2 * | 3/2011 | LaGrange | E21B 43/1185 | 166/373 |
| 8,365,824 B2 * | 2/2013 | Phillips | E21B 43/11852 | 166/297 |
| 8,540,027 B2 * | 9/2013 | Wesson | E21B 43/114 | 166/298 |

(Continued)

*Primary Examiner* — Kenneth L Thompson
(74) *Attorney, Agent, or Firm* — Mossman, Kumar & Tyler, PC

(57) ABSTRACT

A downhole tool for performing a wellbore operation includes a perforating gun, a detector module connected to the perforating gun, wherein the detector module transmits a command in response to a signal, a signal generator configured to transmit the signal to the detector module, and a plug dropping mechanism located adjacent to the detector module, the plug dropping mechanism releasing an object upon receiving the command from the detector module. The perforating gun is fired, and the downhole tool is activated. A plug-mate positioned adjacent to the plug dropping mechanism receives the object. The plug-mate has a profile complementary to the object, and the plug-mate and the object cooperating to block flow along the wellbore. In another mode of operation, an actuation member actuates the plug-mate. It is emphasized that this abstract is provided to comply with the rules requiring an abstract, which will allow a searcher or other reader to quickly ascertain the general subject matter of the technical disclosure.

17 Claims, 3 Drawing Sheets

(56) References Cited

U.S. PATENT DOCUMENTS

| | | | | |
|---|---|---|---|---|
| 9,033,041 | B2 * | 5/2015 | Baihly | E21B 23/04 166/250.04 |
| 9,284,817 | B2 * | 3/2016 | Walton | E21B 34/06 |
| 2001/0040030 | A1 * | 11/2001 | Lerche | E21B 41/00 166/63 |
| 2009/0159297 | A1 | 6/2009 | Fould et al. | |
| 2011/0205847 | A1 | 8/2011 | Lemenager | |
| 2012/0043069 | A1 * | 2/2012 | Maranuk | E21B 47/12 166/66 |
| 2013/0020065 | A1 | 1/2013 | Tubel et al. | |
| 2013/0024030 | A1 | 1/2013 | Tubel et al. | |
| 2013/0175053 | A1 | 7/2013 | Madero et al. | |
| 2013/0248174 | A1 * | 9/2013 | Dale | E21B 23/00 166/255.1 |
| 2014/0273831 | A1 * | 9/2014 | Walton | E21B 47/122 455/41.1 |
| 2015/0060064 | A1 * | 3/2015 | Lafferty | E21B 34/14 166/280.1 |
| 2015/0252640 | A1 | 9/2015 | Mailand et al. | |
| 2015/0252643 | A1 | 9/2015 | Mailand et al. | |
| 2016/0061018 | A1 * | 3/2016 | Ditzler | E21B 47/06 166/250.04 |

* cited by examiner

SHORT HOP COMMUNICATIONS FOR A SETTING TOOL

BACKGROUND OF THE DISCLOSURE

1. Field of the Disclosure

This disclosure relates generally to oilfield downhole tools and more particularly to methods and devices for selectively plugging or actuating a downhole device.

2. Description of the Related Art

As the oil and gas industry continues to explore and produce from wells that are deeper, designing downhole tools that can operate in sequential zone completion and intervention becomes a challenge. Plugging and perforating or re-perforating, or actuating tools in a deep well environment can be difficult if subterranean tools such as perforating guns malfunction. This is particularly the case when the actuation of another tool relies on, for example, the proper firing of a perforating gun. In some aspects, the present disclosure is directed to methods and devices for short hop communications downhole to selectively actuate subterranean tools.

SUMMARY OF THE DISCLOSURE

In one aspect, the present disclosure provides an apparatus for performing a downhole operation. The apparatus may include a perforating gun, a detector module connected to the perforating gun, the detector module transmitting a command in response to a signal, and a signal generator configured to transmit the signal to the detector module. The apparatus may also have a plug dropping mechanism located adjacent to the detector module, and a plug-mate positioned in the wellbore. The plug dropping mechanism releases an object upon receiving the command from the detector module. The plug-mate has a profile complementary to the object. The plug-mate and the object cooperates to block flow along the wellbore.

In another aspect, the present disclosure provides a method of performing a downhole operation in a wellbore. The method may include firing a perforating gun, activating a short hop communicator, and receiving an object at a plug-mate positioned in the wellbore, the plug-mate having a profile complementary to the object, the plug-mate and the object cooperating to block flow along the wellbore. The short hop communicator may include a detector module connected to the perforating gun, wherein the detector module transmits a command in response to a signal, a signal generator configured to transmit the signal to the detector module, and a plug dropping mechanism located adjacent to the detector module, the plug dropping mechanism releasing the object upon receiving the command from the detector module.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

The present disclosure relates to apparatuses and methods for actuating a frac plug even if an associated perforating gun malfunctions. In embodiments, the downhole device uses a short hop communicator that selectively releases an object to actuate the frac plug. When released, the object blocks flow through the frac plug and thereby blocks flow through the casing bore. This allows fluid circulation for taking remedial action (e.g., running in a replacement perforating gun) if the perforating gun malfunctions.

Illustrative shock wave detection devices that are actuated directly by perforating gun firing are discussed in the co-pending applications with U.S. Ser. No and filing date, respectively, the contents of which are incorporated by reference for all purposes: Ser. No. 14/202,974, Mar. 10, 2014; Ser. No. 14/203,072, Mar. 10, 2014; and Ser. No. 14/203,029, Mar. 10, 2014.

Figure 1:
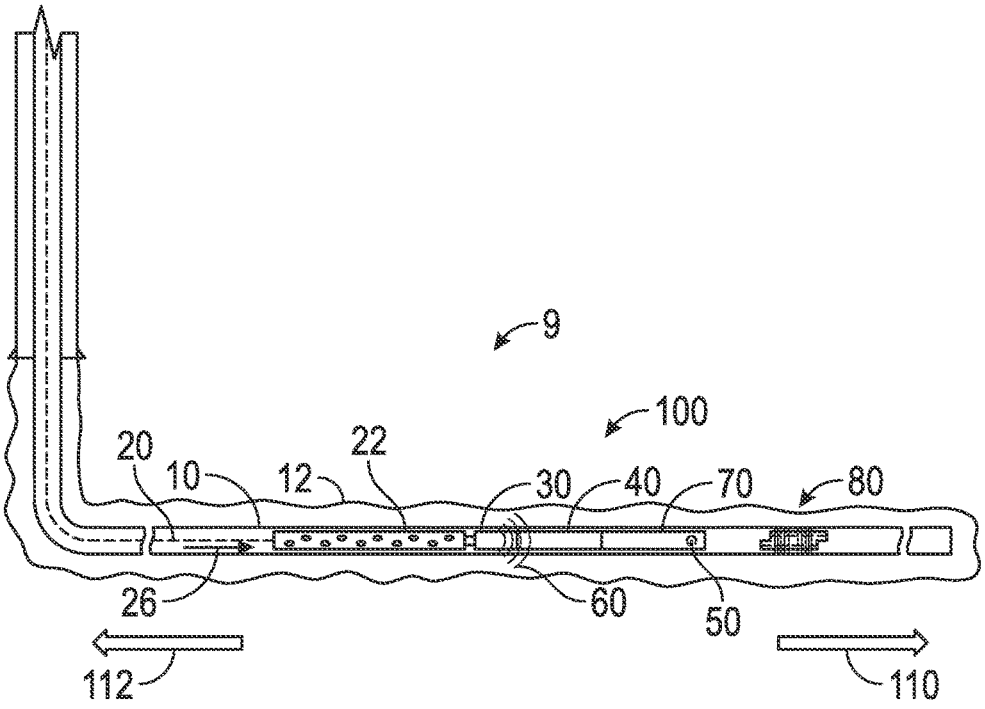
FIG. 1 shows an exemplary short hop communicator and a frac plug in a wellbore according to the present disclosure.

FIG. 1 shows one non-limiting embodiment of a short hop communicator 100 used in connection with a bottom hole assembly (BHA) adapted for a plug and perf fracturing operation. The BHA 9 is deployed in a desired location of the casing 10 in a wellbore 12. The BHA 9 comprises perforating guns 22 followed by the short hop communicator 100 in a direction 110 and a plug-mate 80. The plug-mate 80 can be a frac plug or a composite frac plug. The BHA may be run in on wireline 20 or other suitable non-rigid carrier.

The short hop communicator 100 has a signal generator 30, a detector module 40 and a plug dropping mechanism 70. The signal generator 30 creates a signal 60 to activate the detector 40 in response to the firing of the perforating guns 22. The signal generator 30 may be a Bluetooth® device, a wireless device, an acoustic source, an acoustic modem, or other communication device. The signal 60 may be a radio frequency wave, electromagnetic wave, an acoustic wave or other stimulus, which is transmitted when the noise or shock reaches above a level that would be created by the perforating gun 22.

As noted above, the signal generator 30 may be programmed to transmit a signal upon detecting a specific condition; e.g., the firing of the perforating gun 22. Alternatively, the signal generator 30 may be programmed to transmit the signal 60 after receiving a command signal sent from the surface.

Figure 2:
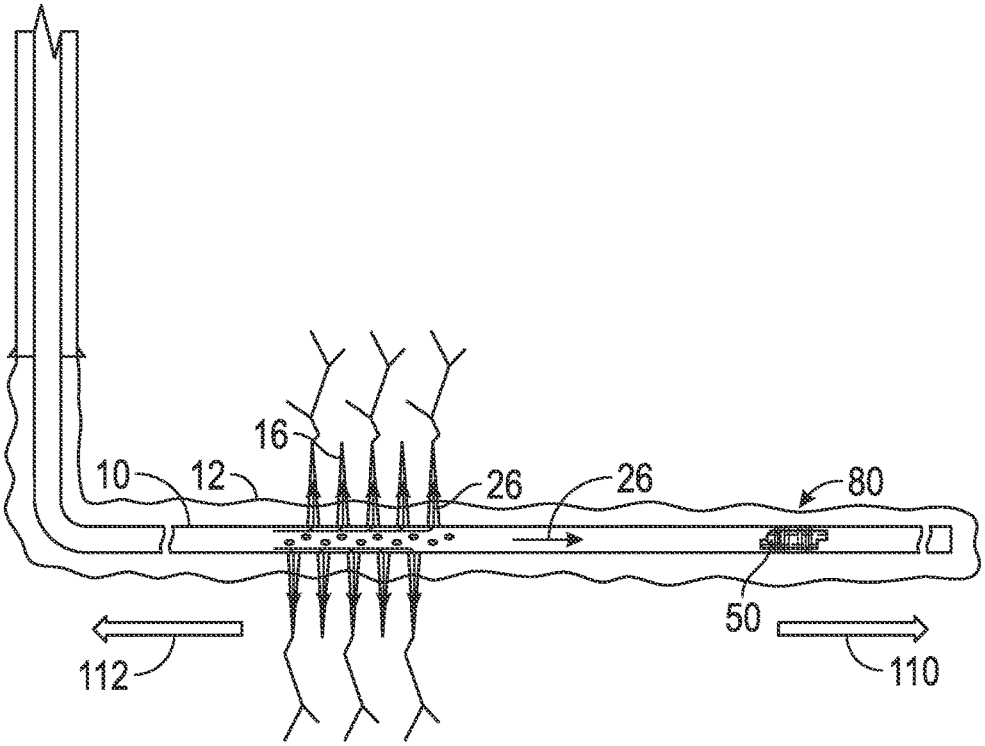
FIG. 2 shows an exemplary fracing operation after the object seats on a frac plug in a wellbore.

In response to the signal 60, the detector 40 actuates the plug dropping mechanism 70. The plug dropping mechanism 70 releases the object 50. A pumped fluid 26 conveys the object 50 to the plug-mate 80. The frac plug or plug-mate 80 has a through passage and a surrounding seat on which the object 50 may land. The object 50 may be a ball, a dart, a plug, a pig or a flow obstructer designed to land in and seal the passage of the plug-mate 80. FIG. 2 shows the perforations 16 after the perforating gun 22 fires. The object 50 has sealed the passage of the plug-mate 80, which then directs the flow 26 toward the perforations 16. Now, fracing operation can be performed.

Illustrative embodiments and the operation of short hop communicator 100 to release the object 50 will be discussed with reference to FIGS. 3 and 4.

Figure 3:
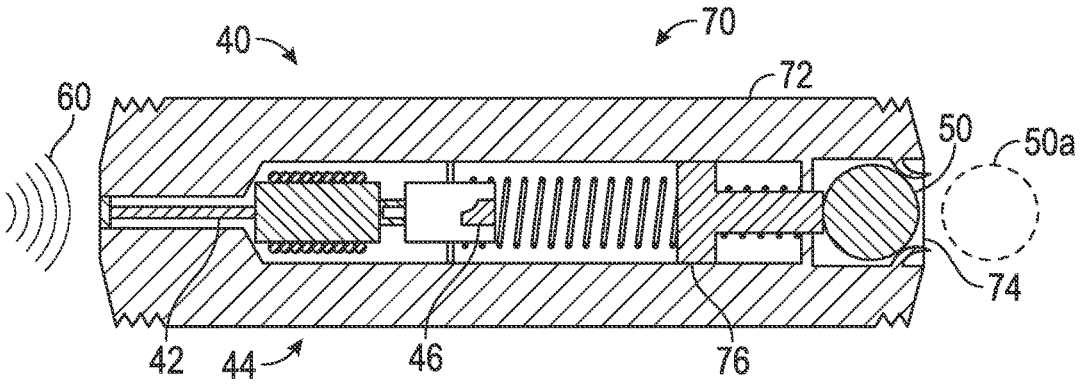
FIG. 3 shows an exemplary detector module and a plug dropping mechanism with an object.

FIG. 3 shows the short hop communicator 100 prior to and after the release of the object 50, respectively. The short hop communicator 100 is run downhole as the detector module 40 is positioned next to the plug dropping mechanism 70. The signal generator 30 is uphole of the detector 40 sends the signal 60 to the detector 40. Uphole of a tool is a location between the tool and the surface, and downhole of a tool is a location between the tool and the wellbore bottom.

The detector 40 has a receiver 42, such as an antenna, a convertor 44, such as an electromagnet mechanism that converts the electromagnetic energy into kinetic energy, and a blocker 46. The convertor 44 may include electronics to read the signal 60. The blocker 46 holds the plug dropping mechanism 70 in a retracted position using a biasing member, for example, a spring. The plug dropping mechanism 70 located in a housing 72 has an actuation member 76. The housing 72 includes the object 50 and an aperture 74 for the object 50 to exit the housing 72.

After the signal 60 is sent from the surface or generated downhole according to the status of the perforating guns 22, the receiver 42 detects and transmits the signal to the convertor 44. The convertor 44 converts the electromagnetic energy into kinetic energy to unlock the blocker 46. When the blocker 46 is unlocked, the actuation member 76 is urged towards the object 50. Therefore, the biasing member forces the actuation member 76 to push out the object 50 through the aperture 74. Therefore, the object 50*a* becomes free to land on the frac plug 80.

Figure 4:
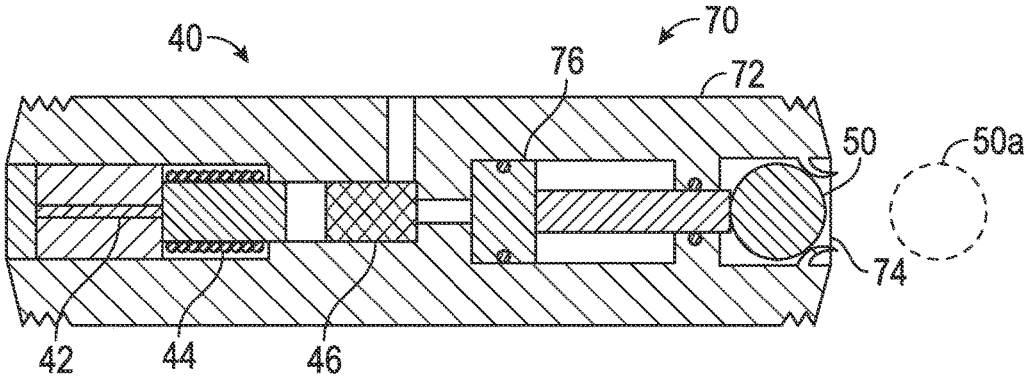
FIG. 4 shows an exemplary detector module and a plug dropping mechanism with an object.

FIG. 4 shows the plug dropping mechanism 70 activated by pressure. The blocker 46 isolates fluid pressure outside the housing 72 from the inside of the housing 72. After receiving the command signal 60, the convertor 44 moves the blocker 46, which exposes an end of the actuation member 76 to a higher pressure than the pressure of the inside of the housing 72. The pressure differential strokes the actuation member 76 and ejects the object 50*a* through the aperture 74 out of the housing 72.

It should be understood that the teachings of the present disclosure are susceptible to numerous variants. Certain non-limiting variations are described below.

Figure 5:
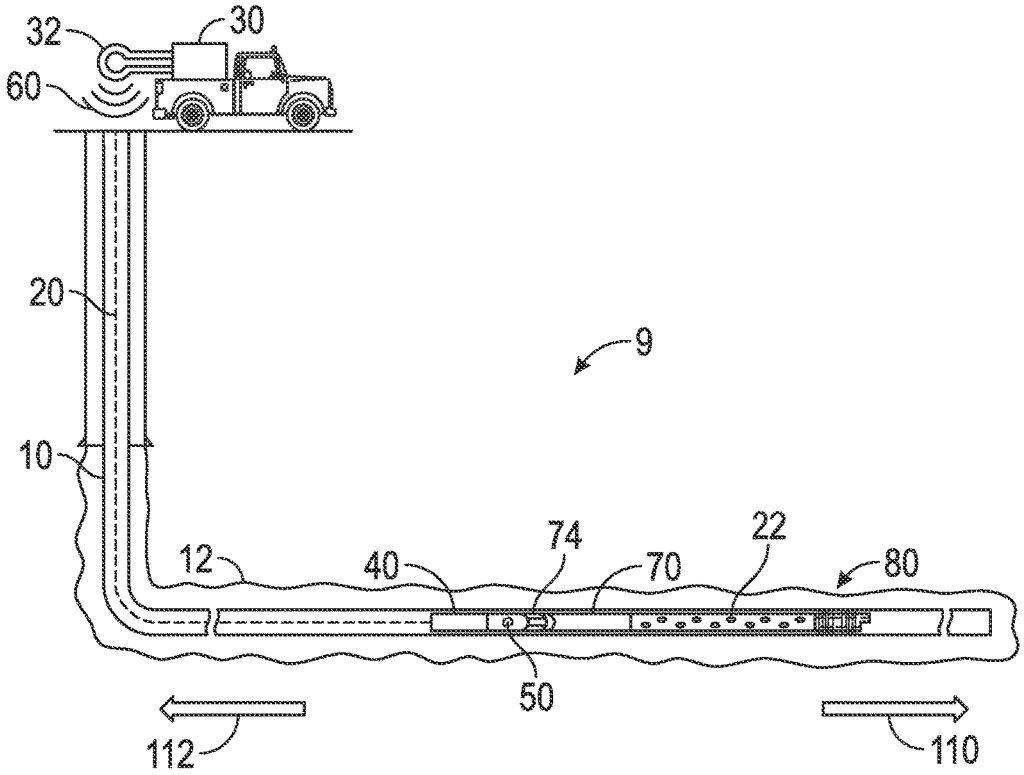
FIG. 5 shows an exemplary short hop communicator and a frac plug in a wellbore.

In the FIG. 5 embodiment, the signal generator 30 may actively be controlled from the surface. The signal generator 30 may have a transmitter 32 to send the command signal 60 to the detector 40 to actuate the plug dropping mechanism 70. The relative arrangements of the BHA 9 also can have several variations. For example, the plug dropping mechanism 70 may be uphole of the perforating gun 22. Also, the detector 40 and the plug dropping mechanism 70 may be uphole of the perforating gun 22. In this embodiment, after the perforating gun 22 is fired, the object 50 is released. The object 50 passes through the aperture 74 and traverses a gap along the casing 10 to reach the frac plug 80.

In FIG. 1, the plug dropping mechanism 70 is separated by an axial gap from the plug-mate 80 and without any intervening equipment. In another embodiment, the plug dropping mechanism 70 may be connected to the frac plug 80. Alternatively, the object 50 may drop through another tool such as a tube (not shown) disposed between the plug dropping mechanism 70 and the frac plug 80.

In some embodiments, the plug-mate 80 and the BHA 9 may be conveyed into the wellbore 12 on the same tool string. In other embodiments, the plug-mate 80 is conveyed into the wellbore 12 separately from the BHA 9. Likewise, the plug-mate 80 and the short hop communicator 100 may be assembled at the surface and deployed downhole. Or, they may be deployed separately.

In some arrangements, a perforating tool may include several stages of the perforating gun 22. In such embodiments, the signal generator 30 may programmed to send the signal 60 according to several schemes. For example, the signal 60 may be sent after the first firing is detected or after the firing of multiple stages of the guns 22.

It should be understood that the present disclosure may be used to actuate any number of secondary tools. That is, the perforating gun 22 is merely illustrative of a primary tool that initiates a downhole operation and the frac plug/plug-mate 80 is merely illustrative of a secondary tool that is used in connection with the primary tool. Thus, the short hop communicator 100 may be reconfigured as needed to accommodate other types of well tools.

Figure 6:
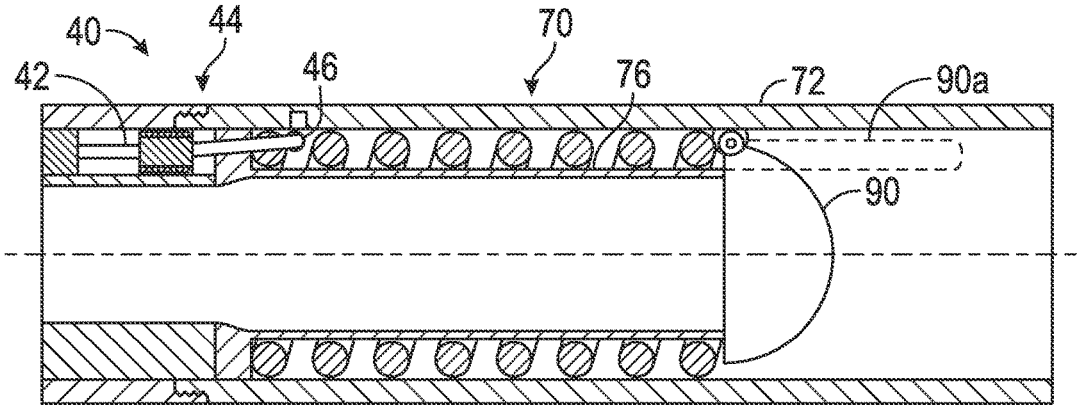
FIG. 6 shows an exemplary detector module and an actuation member.

For instance, as depicted in FIG. 6, the actuation member 76 itself may actuate a secondary tool. The secondary tool may operate a valve, shear a member, move a member, fracture, acidize, stimulate the well, or perform other wellbore operations. The short hop communicator 100 is shown in the run-in position and the actuation member 76 is not released. The actuation member 76 may be a tubular and formed of one or more elements. The secondary tool may include a flapper valve 90. When the short hop communicator 100 is activated, the blocker 46 is released and the actuation member 76 pushes the flapper valve 90*a* open. Optionally, the flapper valve 90 may be located uphole of the plug dropping mechanism 70. In that case, the actuation member 76 may stroke in the uphole direction 112 depending on the axial positioning of the subterranean device 90 with respect to the plug dropping mechanism 70 and the need to push or pull the subterranean device 90.

The foregoing description is directed to particular embodiments of the present disclosure for the purpose of illustration and explanation. It will be apparent, however, to one skilled in the art that many modifications and changes to the embodiment set forth above or embodiments of different forms are possible without departing from the scope of the disclosure. It is intended that the following claims be interpreted to embrace all such modifications and changes.

We claim:

1. An apparatus for performing a downhole operation in a wellbore, comprising:

a perforating gun;

a detector module connected to the perforating gun, wherein the detector module transmits a command in response to a signal;

a signal generator configured to transmit the signal to the detector module;

a plug dropping mechanism located adjacent to the detector module, the plug dropping mechanism releasing an object upon receiving the command from the detector module; and a plug-mate positioned in the wellbore, the plug-mate having a profile complementary to the object, the plug-mate and the object cooperating to block flow along the wellbore.

2. The apparatus of claim 1, wherein the signal comprises at least one of: (i) a radio frequency wave, (ii) an acoustic wave, and (iii) other stimulus.

3. The apparatus of claim 1, wherein the signal generator comprises at least one of: (i) a Bluetooth® device, (ii) a wireless device, (iii) an acoustic source, (iv) an acoustic modem, and (v) other communication device.

4. The apparatus of claim 1, wherein the signal generator is configured to transmit the signal in response to a detonation of the perforation gun.

5. The apparatus of claim 1, wherein the detector module comprises a receiver that detects the signal, and a converter that converts the detected signal into mechanical movement.

6. The apparatus of claim 1, wherein the plug dropping mechanism comprises a housing that includes an aperture, an actuation member disposed in the housing and connected to the detector, wherein an outer dimension of the object is smaller than an inner dimension of the aperture.

7. The apparatus of claim 1, wherein the plug dropping mechanism comprises a low pressure chamber and an actuation member positioned adjacent to the low pressure chamber, wherein the detector includes a blocker located adjacent a port of the low pressure chamber, wherein the detector moves the blocker to open the port, and wherein a fluid flow through the port shifts the actuation member to release the object.

8. The apparatus of claim 1, wherein the plug dropping mechanism is located downhole of the perforating gun.

9. The apparatus of claim 1, wherein the object is at least one of: (i) a ball, (ii) a dart, (iii) a plug, (iv) a pig, and (v) a flow obstructer.

10. The apparatus of claim 1, wherein the signal generator is located at the surface.

11. The apparatus of claim 1, wherein the plug-mate is a composite frac plug.

12. The apparatus of claim 1, wherein the plug-mate is separated by a gap from the plug dropping mechanism.

13. The apparatus of claim 1, wherein:

the signal comprises a radio frequency wave and the signal generator is configured to transmit the radio frequency wave in response to a detonation of the perforation gun, the detector module located in the downhole direction of the signal generator comprises a receiver that detects the radio frequency wave, and a converter that converts the detected radio frequency wave into mechanical movement, the plug dropping mechanism is located between the detector and the perforating gun and comprises a housing that includes an aperture and an actuation member disposed in the housing and connected to the detector, and the object is a plug that is configured to seal the plug-mate after the plug dropping mechanism releases the plug.

14. A method of performing a downhole operation in a wellbore, comprising:

firing a perforating gun;

activating a short hop communicator that includes:

a detector module connected to the perforating gun, wherein the detector module transmits a command in response to a signal;

a signal generator configured to transmit the signal to the detector module; and a plug dropping mechanism located adjacent to the detector module, the plug dropping mechanism releasing an object upon receiving the command from the detector module; and receiving the object at a plug-mate positioned in the wellbore, the plug-mate having a profile complementary to the object, the plug-mate and the object cooperating to block flow along the wellbore.

15. The method of claim 14, further comprising sending the signal after firing the perforating gun.

16. The method of claim 14, further comprising running the plug-mate to a subterranean location separately from the short hop communicator.

17. The method of claim 14, further comprising performing stimulating, acidizing or fracturing a formation through perforations made by the gun.

* * * * *